US007733027B2

(12) United States Patent
Körber et al.

(10) Patent No.: US 7,733,027 B2
(45) Date of Patent: Jun. 8, 2010

(54) HIGH-PRESSURE MERCURY VAPOR LAMP INCORPORATING A PREDETERMINED GERMANIUM TO OXYGEN MOLAR RATIO WITHIN ITS DISCHARGE FILL

(75) Inventors: Achim Gerhard Rolf Körber, Kerkrade (NL); Rainer Hilbig, Aachen (DE); Robert Peter Scholl, Roetgen (DE); Johannes Baier, Würselen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 997 days.

(21) Appl. No.: 10/585,708

(22) PCT Filed: Jan. 5, 2005

(86) PCT No.: PCT/IB2005/050035

§ 371 (c)(1),
(2), (4) Date: Jul. 11, 2006

(87) PCT Pub. No.: WO2005/071711

PCT Pub. Date: Aug. 4, 2005

(65) Prior Publication Data

US 2009/0184644 A1 Jul. 23, 2009

(30) Foreign Application Priority Data

Jan. 15, 2004 (EP) ..... 04100110

(51) Int. Cl.
*H01J 61/20* (2006.01)
*H01J 17/20* (2006.01)

(52) U.S. Cl. ..... 313/639; 313/637; 313/638

(58) Field of Classification Search ..... 313/637–643
See application file for complete search history.

(56) References Cited

U.S. PATENT DOCUMENTS

| | | | | | |
|---|---|---|---|---|---|
| 653,878 | A | | 7/1900 | Pevey | |
| 3,764,843 | A | * | 10/1973 | Van Eiji et al. | 313/639 |
| 3,868,525 | A | * | 2/1975 | Waymouth et al. | 313/633 |
| 4,274,029 | A | * | 6/1981 | Buxbaum | 313/112 |
| 4,918,352 | A | | 4/1990 | Hess et al. | |
| 5,109,181 | A | * | 4/1992 | Fischer et al. | 313/571 |
| 5,212,424 | A | | 5/1993 | Russell et al. | |

FOREIGN PATENT DOCUMENTS

WO WO 02101789 A1 * 12/2002

* cited by examiner

*Primary Examiner*—Mariceli Santiago

(57) ABSTRACT

A high-pressure mercury vapor lamp suitable for sterilization purposes. Germanium and oxygen are added in small quantities to the mercury and/or the mercury halides, with a molar ratio of germanium to oxygen being greater than 1. The addition of germanium monoxide increases the GAC efficiency (GAC: short for Germicidal Action Curve) of a high-pressure mercury vapor lamp, because germanium monoxide emits a strong molecular band system in the range from 250 to 280 nm.

11 Claims, 2 Drawing Sheets

Figures 1, 2:
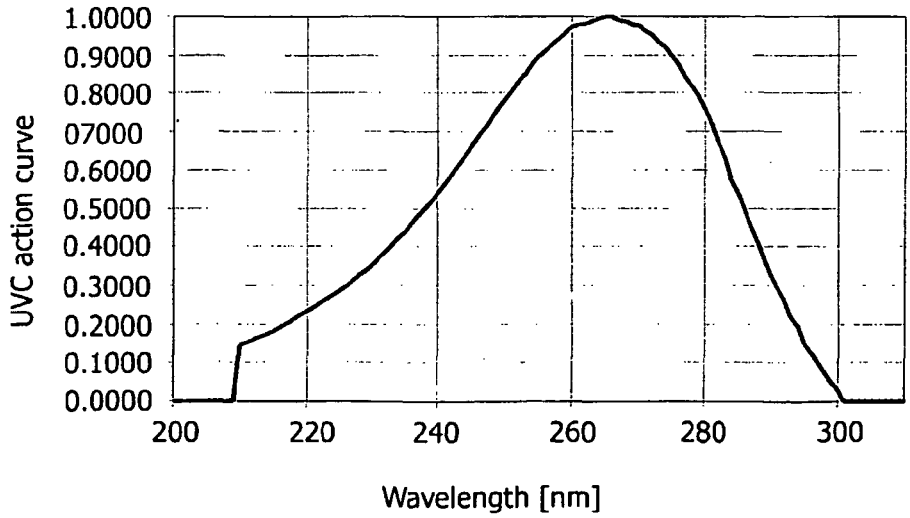

| lamp | filling | filled element sum pressure (for $T_{eff}$ =2500K) | GAC efficiency |
|---|---|---|---|
| HOK-Ref. | 25.4 mg Hg, 0.27 mg $HgBr_2$ | 8.1bar Hg, 0.07 bar Br | 12.4% |
| HOK+ GeO | 25.7 mg Hg, 0.21 mg $HgBr_2$, 0.26 mg $GeO_2$, 0.25 mg Ge | 8.1bar Hg, 0.07 bar Br,0.37 bar Ge, 0.31bar O | 13.6% (=110% of the reference) |

HIGH-PRESSURE MERCURY VAPOR LAMP INCORPORATING A PREDETERMINED GERMANIUM TO OXYGEN MOLAR RATIO WITHIN ITS DISCHARGE FILL

The invention relates to a high-pressure mercury vapor lamp suitable for sterilization purposes.

High-pressure mercury vapor lamps operate according to the principle of discharge lamps in general. Discharge lamps in general utilize the circumstance that free electrons excite gas or metal vapor atoms by means of collisions, which atoms then directly emit radiation in the UV range or transmit the energy to phosphors on the inner wall of the discharge vessel of the discharge lamp which convert this energy into UV radiation. The gas discharge takes place either at low pressure, i.e. at less than 1 bar, and is denoted low-pressure discharge, or it takes place at a high operational pressure, i.e. at more than 1 bar, in which case it is called a high-pressure discharge. The invention to be described below relates to a high-pressure discharge lamp.

Discharge lamps are among the light sources which are used for sterilization by means of ultraviolet radiation, in particular UV-C radiation in a wavelength range of 200 to 280 nm. It is especially the radiation in the wavelength range from 240 to 290 nm that is effective for sterilization. The sterilization effect of the emission spectrum of a light source is evaluated on the basis of the so-termed "Germicidal Action Curve Efficiency", denoted the GAC efficiency for short below.

It is to be noted on the concept of "Germicidal Action" that, for example, the water treatment industry uses special UV lamps for disinfection of drinking water, which lamps radiate an intense light at a wavelength of 253.7 nm which has a strong germicidal action. The optimum germicidal effect is achieved with ultraviolet light in the wavelength range of approximately 260 nm. The maximum of the light absorption by the nucleic acids of the genetic material of micro-organisms also lies near this wavelength. The ultraviolet radiation leads to a change in the genetic material of the DNA or RNA of micro-organisms. This leads to a reduction in their ability to propagate. The disinfection by means of ultraviolet radiation does not require a long exposure time, since the processes take place in fractions of a second. Ultraviolet light at this germicidal wavelength thus changes the genetic material of the cells such that bacteria, viruses, algae, and other micro-organisms can no longer reproduce.

The following types of discharge lamps are known in the field of sterilization by means of ultraviolet radiation: low-pressure gas discharge lamps emitting directly in the UV-C range, discharge lamps based on so-called "corona discharges", which are coated with a phosphor layer emitting UV-C radiation, and high-pressure gas discharge lamps such as high-pressure mercury vapor lamps.

It is a problem with the lamps of the first and the second type that they do indeed have a very high efficacy in the generation of UV-C radiation from an electric current, but that their radiance is insufficient for many applications. It is a problem of the lamp type mentioned last, the high-pressure mercury vapor lamps, however, that they have a low conversion efficacy for the UV-C radiation range, whereas the radiance is sufficient.

A gas discharge lamp is known from U.S. Pat. No. 4,274,029 which is partly coated on the inside with a metal oxide, for example a germanium oxide, so as to prolong lamp life. Gas discharge lamps are known from the patents U.S. Pat. Nos. 4,918,352 and 5,212,424 which contain mercury and metal halides, among them also germanium halide. Here, again, a long lamp life is achieved thereby in combination with a high luminance/radiance. Mercury vapor, however, is also used for low-pressure discharge lamps as described, for example, in U.S. Pat. No. 6,538,378. It is common to all known gas discharge lamps until now that they are incapable of complying with the requirements to a desired degree as regards a strong sterilization effect, evaluated on the basis of the GAC efficiency, in combination with a high radiance.

It is an object of the present invention to provide a discharge lamp which has a high radiance and a high GAC efficiency.

According to the invention, this object is achieved by means of a high-pressure mercury vapor lamp in whose discharge vessel, for example a bulb of quartz glass, small quantities of germanium and oxygen are added to the mercury or the mercury halides, or to both these components. Surprisingly, the addition of germanium and oxygen clearly enhances the GAC efficiency of a high-pressure mercury vapor lamp.

Thermochemical calculations and experiments with different molar mixing ratios of germanium and oxygen show that a corrosion reaction forming silicates, in particular forming $GeSi_9O_{20}$, takes place if the lamp wall has quartz as a constituent material and the total introduced molar quantity of germanium is smaller than the total molar quantity of oxygen introduced. If excess germanium is introduced in relation to oxygen, there is a lack of oxygen for forming silicates. The considerably larger number of oxygen atoms in the silicate $GeSi_9O_{20}$ compared with $SiO_2$ is of importance here. The addition of germanium and oxygen in small quantities should accordingly involve a dosage of germanium in excess with respect to oxygen, such that said corrosion reaction does not take place.

In a special embodiment of the high-pressure mercury vapor lamp, 1 to 10 micromoles per cubic centimeter of mercury and in addition 0.1 to 10 micromoles per cubic centimeter of germanium monoxide are used. The introduced molar quantities of mercury and germanium monoxide may be independently chosen within said ranges. The advantage arises here that germanium monoxide emits a strong molecular band system in the range from 250 to 280 nm. In a further embodiment, additional germanium is introduced compared with the filling of the previous embodiment, so that the molar ratio of germanium to oxygen is greater than 1.

It is furthermore advantageous to add to the described ingredients of mercury, germanium, and oxygen also a small quantity of a halogen, for example iodine, bromine, chlorine, or mixtures of these elements, so as to reduce the blackening of the lamp wall by tungsten evaporated from the electrodes by means of a so-called regenerative chemical tungsten cycle. The added halogen quantity will vary in dependence on the reactivity of the halogen or halogen mixture and the quantity of mercury. If pure iodine is used, 0 to 100% of the molar quantity of mercury is added, with the use of pure bromine 0.1 to 10% of the molar quantity of mercury, and with the use of pure chlorine 0.01 to 1% of the molar quantity of mercury.

Preferably, a burner with a power rating of between 10 and 10,000 W is operated for exciting the ionized gases or metal vapors in the discharge vessel.

In a preferred embodiment, the discharge vessel of the high-pressure mercury vapor lamp is made of quartz glass or a ceramic material such as densely sintered aluminum oxide, yttrium oxide, yttrium-aluminum garnet, or a similar material.

The supply of electric power may take place by means of tungsten electrodes, or in an electrodeless manner through the use of high-frequency radiation in a wavelength range from 100 kHz up to 100 GHz.

The invention will be explained by way of example below with reference to the Figures, in which:

FIG. 1 is a comparative Table of lamps, i.e. a conventional high-pressure mercury vapor lamp denoted HOK–Ref, and a high-pressure mercury vapor lamp according to the invention denoted HOK+GeO, as regards their fillings, the filling pressures of the respective elements, and the GAC efficiency.

The GAC efficiency for a lamp is calculated in that the emitted spectral radiation power, in watts per nanometer, for each wavelength is multiplied by the corresponding value for this wavelength in accordance with the Germicidal Action Curve. Such a germicidal action curve is shown in FIG. 2. The resulting product is integrated over all wavelengths. Two such integrals are, for example, the two area integrals defined by the curves in FIG. 3. Finally, the calculated integral value is put in relation to the electrical input power for the lamp. The filling quantity is indicated in milligrams in the Table, and it is apparent that the high-pressure mercury vapor lamp according to the invention contains not only mercury (Hg), mercury dibromide ($HgBr_2$), and germanium (Ge), but also germanium monoxide (GeO). The total pressures of the elements are indicated in bar. The GAC efficiency of the high-pressure mercury vapor lamp HOK+GeO according to the invention, indicated in percents, of 13.6% lies approximately one tenth higher than the GAC efficiency of 12.4% of the conventional high-pressure mercury vapor lamp HOK–Ref.

FIG. 2 shows a Germicidal Action Curve (GAC) with the wavelength of a UV radiation plotted in nanometers on the abscissa, and the corresponding germicidal action on the ordinate, where the maximum germicidal action is defined by the value 1.0000. It is clear that the Germicidal Action Curve reaches its maximum at a wavelength of 265 nm. The germicidal action is strongest at this wavelength.

Figure 3:
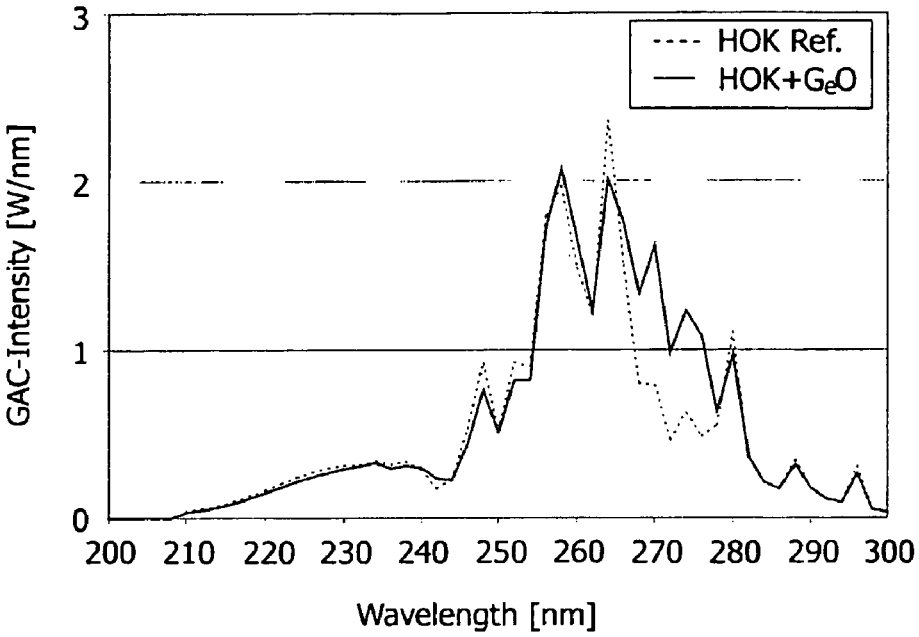

FIG. 3 shows a comparison of the germicidal actions of the two lamps of FIG. 1, showing their respective GAC intensities in watts per nanometer. The GAC intensity is calculated in that the emitted spectral radiant power, in watts per nanometer, for each wavelength is multiplied by the corresponding value for this wavelength from the Germicidal Action Curve of FIG. 2. The conventional high-pressure mercury vapor lamp HOK–Ref is represented by the broken line, and the high-pressure mercury vapor lamp according to the invention HOK+GeO is represented by the continuous line. It is apparent that the integral over the wavelength range between 210 and 300 nm gives a higher value for the high-pressure mercury vapor lamp according to the invention HOK+GeO than does the integral for the conventional high-pressure mercury vapor lamp HOK–Ref. This demonstrates that the germicidal action of the high-pressure mercury vapor lamp according to the invention HOK+GeO with germanium and germanium monoxide is greater than that of the conventional high-pressure mercury vapor lamp HOK–Ref.

The invention claimed is:

1. A light source suitable for ultraviolet radiation, comprising a discharge lamp, wherein the discharge lamp is a high-pressure mercury vapor lamp comprising a mercury and/or mercury halides disposed in a discharge vessel; wherein germanium and oxygen are added to the discharge vessel, a molar ratio of germanium to oxygen being greater than 1.

2. The light source of claim 1, wherein the discharge lamp includes 1 to 100 micromoles per cubic centimeter of mercury and 0.1 to 10 micromoles per cubic centimeter of germanium monoxide.

3. The light source of the claim 1, further comprising: a halogen selected from a group consisting of: iodine, bromine, chlorine, or combination thereof.

4. The light source of claim 3, wherein the halogen is formed by adding pure iodine in a quantity of 1 to 100% of a molar quantity of the mercury.

5. The light source of claim 3, wherein the halogen is formed by adding pure bromine in a quantity of 0.1 to 10% of a molar quantity of mercury.

6. The light source of claim 3, wherein the halogen is formed using pure chlorine in a quantity of 0.01 to 1% of a molar quantity of the mercury.

7. The light source of claim 1 wherein the high-pressure mercury vapor lamp further comprises a burner configured to operate with a power of between 10 and 10,000 W.

8. The light source of claim 1, wherein the discharge vessel comprises quartz glass or a ceramic material.

9. The light source of claim 1, wherein the discharge lamp further comprises a source of electrical power including tungsten electrodes.

10. The light source of claim 1, wherein the source of electrical power uses high-frequency radiation in a wavelength range from 100 kHz to 100 GHz.

11. A method for minimizing corrosion of a discharge vessel of a high-pressure mercury vapor lamp having a mercury and/or a mercury halides disposed in the discharge vessel, the method comprising step of adding germanium and oxygen to the mercury and/or to the mercury halides, such that the discharge lamp includes 1 to 100 micromoles per cubic centimeter of mercury and 0.1 to 10 micromoles per cubic centimeter of germanium monoxide, and a molar ratio of the germanium to the oxygen is greater than 1.

* * * * *